United States Patent [19]

Cillario

[11] 4,314,650

[45] Feb. 9, 1982

[54] PACKAGE COMPRISING A CREAMY CONFECTIONERY PRODUCT

[76] Inventor: Renzo Cillario, Corso Fratelli Bandiera 3, Alba (Cuneo), Italy

[21] Appl. No.: 191,205

[22] Filed: Sep. 26, 1980

[30] Foreign Application Priority Data

Oct. 25, 1979 [IT] Italy ..... 53683/79[U]

[51] Int. Cl.[3] ..... B65D 1/38; A47G 19/00

[52] U.S. Cl. ..... 220/23.83; 206/562; 206/526; 220/20; 220/23.4; 426/115; 426/119; 426/120

[58] Field of Search ..... 426/115, 119, 120, 124, 426/108; 220/23.8, 23.83, 23.86, 23.4, 20; 206/562, 526

[56] References Cited

U.S. PATENT DOCUMENTS

| | | | |
|---|---|---|---|
| 943,162 | 12/1909 | Schlesinger | 220/23.83 |
| 1,514,379 | 11/1924 | Fleischer | 426/120 |
| 2,096,825 | 10/1937 | Roman | 426/115 |
| 2,107,239 | 2/1938 | Eckhoff | 220/20 |
| 2,210,521 | 8/1940 | Bemis | 220/23.83 |
| 2,211,816 | 8/1940 | Heise | 426/120 |
| 2,352,684 | 7/1944 | Braddock | 220/23.8 |
| 2,981,039 | 4/1961 | Pohl | 426/108 |
| 3,240,610 | 3/1966 | Cease | 426/114 |
| 3,390,766 | 7/1968 | Stockdale | 426/108 |
| 3,561,668 | 2/1971 | Bergstrom | 426/124 |
| 3,610,458 | 10/1971 | Nissley | 220/23.4 |
| 3,624,787 | 11/1971 | Newman | 426/115 |
| 3,654,746 | 4/1972 | Beckers | 426/108 |
| 3,842,975 | 10/1974 | Chang | 426/115 |
| 3,850,333 | 11/1974 | Reichert | 220/20 |
| 3,924,009 | 12/1975 | Goldberg et al. | 426/120 |
| 4,054,207 | 10/1977 | Lazure et al. | 426/108 |
| 4,097,611 | 6/1978 | Seferth et al. | 426/121 |
| 4,225,052 | 9/1980 | Tector | 220/23.8 |

FOREIGN PATENT DOCUMENTS

| | | | |
|---|---|---|---|
| 2381 | 4/1900 | Austria | 220/23.83 |
| 1252761 | 11/1971 | United Kingdom | 220/23.86 |

*Primary Examiner*—Steven L. Weinstein

*Attorney, Agent, or Firm*—Bernard, Rothwell & Brown

[57] ABSTRACT

The package comprises a base (10) having flat horizontal wall (14) formed with a plurality of apertures (18, 20) and supported by a circumferential depending skirt (16). A flanged cup (28) containing the creamy product is removably inserted into a central aperture (18). Further flanged cups (32) containing comminuted edible ingredients such as peanut, hazel nut, pistachio, puffed rice or chocolate, are inserted into the remaining apertures (20). The whole is closed by a removable lid (12) superposed on the flat wall (14) of the base (10). The package also includes small spoons (40) which may be located in corresponding depressions (not shown) formed in the flat wall (14) of the base (10).

1 Claim, 4 Drawing Figures

PACKAGE COMPRISING A CREAMY CONFECTIONERY PRODUCT

The present invention relates to a package comprising a creamy confectionery product.

The object of the present invention is to provide a practical and functional package formed so as to offer the users the possibility of having available a plurality of solid particulate ingredients of different tastes, separate from each other and from the creamy product, to be added to the creamy product itself at the moment of consumption, at the choice of the consumer.

In order to achieve this object, the present invention has as its subject a package comprising a creamy confectionery product, characterised in that it comprises:

a base having a flat horizontal wall formed with a plurality of seats, a cup containing the creamy product removably inserted into one of the seats, a plurality of cups containing edible solid particulate ingredients inserted into the respective remaining seats, the ingredient in each cup having a taste different from those of the ingredients in the other cups, a removable lid covering the said flat wall of the base and the cups in their seats, and at least one spoon removably carried by the base or lid.

The solid particulate ingredients may be in the form of grains or in the form of particles obtained by comminution. Thus, said ingredients may consist, for example, of fragments of hazel nut, peanut, almond, pistachio nut, or soya bean, crisp granules or grains of various types such as puffed rice, or chocolate fragments.

The base of the package according to the invention lends itself conveniently for use as a carrier tray for the cups at the time of consumption of the creamy product and of the solid ingredients. Since these cups are removably located in the seats of the base, any of them may be removed by the consumer from the package and preserved or conditioned until the moment of use. In particular, the cup with the creamy product may be removed from the base, put into a refrigerator and subsequently re-inserted into the base for consumption.

Preferably, the cup containing the creamy product has dimensions greater than those of the remaining cups. Also, preferably, the flat wall of the base is circular and the seat for the cups containing the creamy product is situated in the centre of the flat wall while the seats for the other cups are distributed around the seat for the cup containing the creamy product.

An embodiment of the invention will now be described in detail with reference to the appended drawings, in which.

Figure 1:
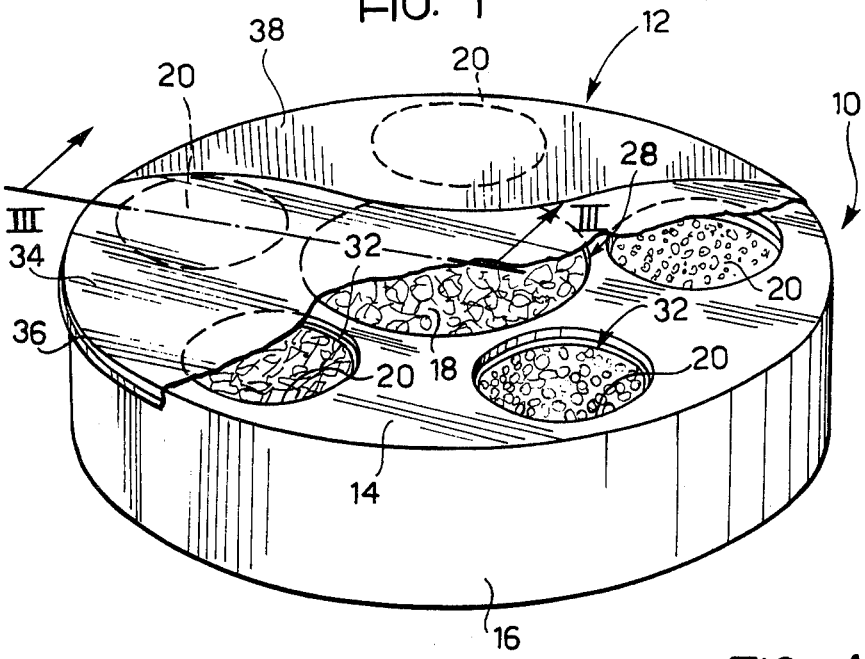
FIG. 1 is a partially broken perspective view of a package according to the invention.

The package according to the invention comprises essentially a base 10 and a lid 12 applied to the upper part of the base 10.

The base 10 comprises a flat, circular horizontal wall 14 of a diameter of 14 cm, for example, having a depending cylindrical circumferential skirt 16 of a height of, say 3.5 cm, which constitutes a mounting for supporting the flat wall 14 spaced upwardly from a bearing plane such as a table. The flat wall 14 and the cylindrical skirt 16 are made in a single piece by thermoforming from a sheet of plastics.

Figure 3:
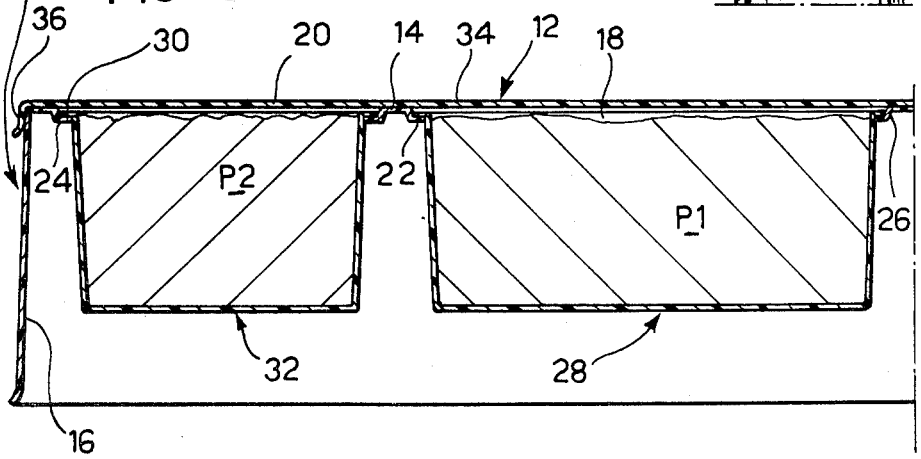
FIG. 3 is a cross-sectional view on line III—III of FIG. 1.
Figure 2:
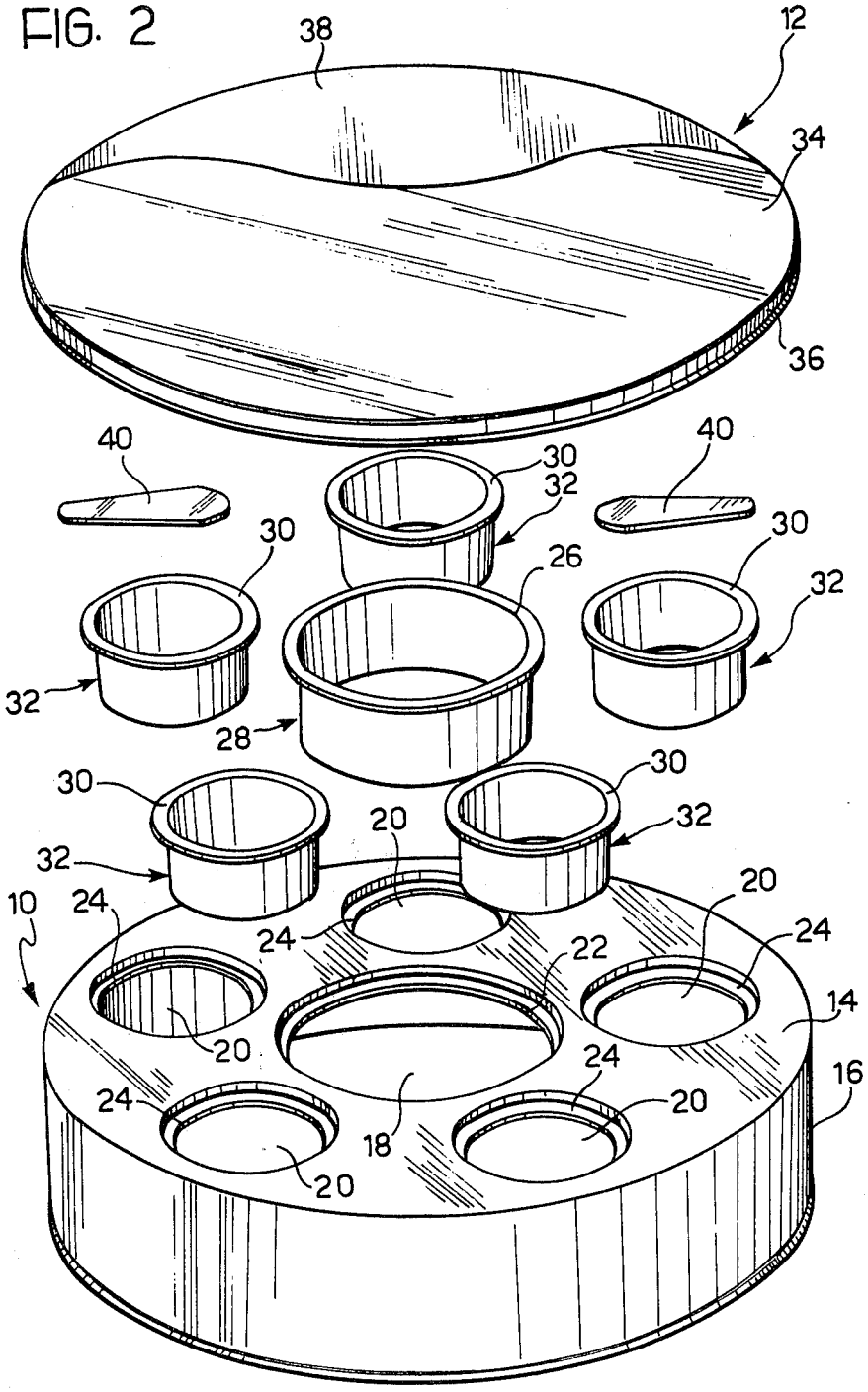
FIG. 2 is an exploded perspective view of FIG. 1.

The flat wall 14 is formed with a central circular aperture 18 and five peripheral, circular apertures 20. The peripheral apertures 20 are equiangularly spaced from each other and have the same diameter, e.g. 3.5 cm, substantially less than that of the central aperture 18, e.g. 6 cm. As is shown in detail in FIGS. 3 and 4, each of the apertures 18, 20 is formed in a corresponding recessed circular zone of the flat wall 14 which has a planar annular wall portion 22, 24 surrounding the edge of the respective aperture 18, 20. The annular wall portion 22 surrounding the edge of the aperture 18 constitutes a bearing surface for a corresponding external annular circumferential flange 26 of a circular cup 28 containing a creamy confectionery product P1. The flange 26 surrounds the mouth of the cup 28 and, on insertion of the cup 28 into the aperture 18, bears on the annular wall 22 so as to support this cup 28 within the space surrounded by the skirt 16 of the base 10.

Each of the annular wall portions 24 simularly constitutes a bearing surface for an external circumferential annular flange 30 of a corresponding circular cup 32 containing a solid granular ingredient P2. The flange 30 of each cup 32 surrounds the mouth of the cup and, on introduction of the cup 32 into the corresponding aperture 20, bears on the respective annular wall portion 24 so as to support the cup 32 within the space surrounded by the skirt 16.

Figure 4:
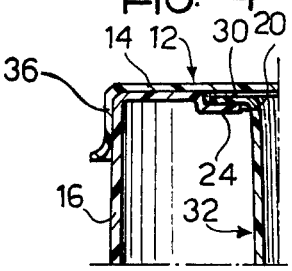
FIG. 4 illustrates a detail of FIG. 3 on an enlarged scale.

The depth at which the annular wall portions 22, 24 are located with respect to the flat wall 14 preferably corresponds to the thickness of the flanges 26, 30 bearing upon said wall portions (FIG. 4). In this manner the cups 28, 32 are closed and held in place by the disc portion of the lid without protuding upwardly from the flat wall 14.

The solid granular ingredients contained in the cups 32 each have a taste different from the others and examples thereof have been given hereinbefore.

From the above it is clear that the central cup 28 and its satellite cups 32 may readily be extracted from, and reinserted into, the respective apertures 18, 20 in the base 10. The cups 28, 32 are preferably made by thermoforming from a sheet of plastics material admitted by food regulations.

The lid 12 consists of a planar disc portion 34 having a diameter corresponding to that of the flat wall 14 of the base 10, and a circumferential, cylindrical depending skirt 36. The skirt 36, the height of which is about one tenth of that of the skirt 16 of the base 10, is adapted to fittingly engage the upper part of the skirt 16. In order to facilitate this engagement, the edge portion of the skirt 36 is flared outwardly as illustrated in detail in FIG. 4. In closed condition, the disc portion 34 overlaps the flat wall 14 of the base 10.

The lid 12 is preferably formed in a single piece by thermoforming from a transparent plastics sheet material. The circular disc portion 34 of the lid 12 may have a peripheral zone 38 rendered non-transparent and overprinted with inscriptions and/or figures relating to the package. This non-transparent peripheral zone preferably extends so as to cover only one of the peripheral apertures 20 containing the cups 32.

The package further includes one or more small spoons 40. By the term "spoon" it is intended to include also similar utensils (e.g. flat blades) usable for taking up portions of the creamy product from the cup 28.

The or each small spoon 40 may be supported on the outside or on the inside of the package, either by the base 10 or by the lid 12. Preferably the spoon is housed in depression of corresponding profile, not illustrated in the drawings, formed in the flat circular wall 16 of the base 10.

With the package according to the invention the solid particulate ingredients are kept separately of the creamy product contained in the central cup 28 and, therefore, are not adversely affected by components such as water, fats or oils usually contained in edible creamy products. The creamy product may be of any convenient taste and the latter may be improved at consumer's choice by combining the product with any of the particulate ingredients comprised by the package. To this end, after having removed the lid 12 from the base 10, the consumer takes up by means of the spoon 40 a portion of the creamy product contained in the cup 28 and to add to it the desired solid particulate ingredient by introducing the cream-filled spoon 40 into the corresponding cup 32 so that the particles stick to the cream on the spoon. Also, if desired, the central cup 28 may readily be extracted from the base 10 before consumption and put into a refrigerator, so as to cool the creamy product contained therein, and be reinserted into the aperture 18 in the base 10 at the moment of consumption.

If necessary or convenient, the central cup 28 containing the creamy product may be sealed by a tearable foil or laminate of plastics.

I claim:

1. A food package comprising a base member having a flat horizontal circular wall having a plurality of apertures therein and a cylindrical supporting skirt depending from the circumference of said wall to support the latter in elevated relation with respect to a plane surface upon which the package may be placed, said apertured wall including a plurality of relatively small, circular apertures equally spaced in a circle about one relatively large centrally located aperture, a relatively large cup adapted to contain a food product being removably inserted into the large aperture and a plurality of relatively small cups adapted to contain related food products for use with the food product in said large cup being removably inserted into the respective small apertures, each of said cups having an external flange surrounding the mouth of said cup and an annular recess in said flat wall surrounding each of said apertures and having a depth substantially equal to the thickness of said flange whereby each cup disposed in an aperture is supported by its flange located in a respective annular recess and the flanges of the cups are flush with the horizontal circular wall of the base and further comprising a lid including a planar circular disc portion superimposed on and in contact with said horizontal circular wall of said base and the top of the flanges of each cup, and the lid further including a flanged circumferential relatively short skirt portion depending from said disc portion in frictional engagement with the upper circumferential portion of the skirt of said base the lower end of the skirt being flared outwardly whereby said lid removably covers the cups supported in each of said recess and isolates the contents of each cup from each other when the lid is installed and the package is moved from a horizontal position.

* * * * *